US005917402A

United States Patent [19]

Ebata

[11] Patent Number: 5,917,402

[45] Date of Patent: Jun. 29, 1999

[54] MOUNTING STRUCTURE FOR MOUNTING AN INSULATING SUBSTRATE HAVING A RESISTOR PATTERN ONTO A HOLDER

[75] Inventor: Junichi Ebata, Miyagi-ken, Japan

[73] Assignee: Alps Electric Co., Ltd., Japan

[21] Appl. No.: 08/885,708

[22] Filed: Jun. 30, 1997

[30] Foreign Application Priority Data

Jul. 2, 1996 [JP] Japan ..... 8-191513

[51] Int. Cl.[6] ..... H01C 10/30

[52] U.S. Cl. ..... 338/160; 338/199

[58] Field of Search ..... 338/160, 161, 338/162, 199, 184, 163, 232, 202

[56] References Cited

U.S. PATENT DOCUMENTS

| | | | |
|---|---|---|---|
| 4,310,824 | 1/1982 | Steigwald et al. | 338/174 |
| 4,884,052 | 11/1989 | Eitoku et al. | 338/202 |
| 5,043,695 | 8/1991 | Simon et al. | 338/199 |
| 5,250,926 | 10/1993 | McSwiggen et al. | 338/164 |

FOREIGN PATENT DOCUMENTS

| | | |
|---|---|---|
| 61-30243 | 9/1986 | Japan . |
| 2-41404 | 3/1990 | Japan . |
| 4-105501 | 9/1992 | Japan . |
| 5-90306 | 12/1993 | Japan . |

*Primary Examiner*—Teresa Walberg
*Assistant Examiner*—Jeffery Pwu
*Attorney, Agent, or Firm*—Brinks Hofer Gilson & Lione

[57] ABSTRACT

A resistor pattern of an insulating substrate is printed with reference to a first contact portion and a second contact portion, and the insulating substrate is attached to a holder such the first and second contact portions of the insulating substrate are brought into contact with second contact portions of the holder to position the insulating substrate. Therefore, an error between the relative positions of a slider piece and a resistor pattern is decreased, and variations in resistance change characteristic are decreased.

14 Claims, 7 Drawing Sheets

MOUNTING STRUCTURE FOR MOUNTING AN INSULATING SUBSTRATE HAVING A RESISTOR PATTERN ONTO A HOLDER

BACKGROUND OF THE INVENTION

1. Field of the Invention

The present invention relates to an electric part which is optimally used, e.g., in an automobile, as a vehicle height sensor for detecting a change in vehicle height with a load or a road condition.

2. Description of the Related Art

An electric part of this type, e.g., a vehicle height sensor, is attached to an automobile. As the vehicle height sensor, the following sensor is used. That is, vibration generated by an uneven load is transmitted from wheels to the body through a buffer, and a change in distance between the body and the wheel shaft, i.e., a change in vehicle height, is detected. Some buffer can automatically adjust the vehicle to buffer characteristics corresponding to the change in vehicle height, as shown in FIGS. 14 and 15, a cylindrical portion 1*a* having opening 1*b* is formed on a one-end side of a housing 1.

A pivotal shaft 3 having one end projecting from the other-end side of the housing 1, a slider receiver 4 fixed on the other end of the pivotal shaft 3 with calking or the like and built in the housing 1, and a resistor pattern 6*a* formed on the upper surface of an insulating substrate 6 opposite to the slider receiver 4 are formed printing or the like with reference to a positioning hole 6*b*. Recessed portions 6*c* are formed in the outside of the insulating substrate 6.

A pair of snap projections 7*a* and a pair of snap projections 7*b* are parallel formed on a holder 7, the snap projections 7*a* and 7*b* are attached to be snap-engaged with the recessed portions 6*c* of the insulating substrate 6. A terminal 8 having one end connected to the resistor pattern 6*a* by soldering, a lead wire 9 is soldered on the other end of the terminal 8, and a filler 10 for airtightly sealing the interior of the housing 1 is filled in the external end of the opening 1*b*. In this case, the holder 7 is attached such that the holder 7 is positioned inside the opening 1*b* and brought into pressure contact with a step portion 1*e*.

A stepped shaft hole 1*d* having an other-side cylindrical member 1*c* communicating with the opening 1*b* is formed at the shaft center portion of the housing 1. A bearing 11 is formed from the opening 1*b* onto the step portion of the stepped shaft hole 1*d* by press fitting or insert molding. The pivotal shaft 3 is pivotally supported by the bearing 11. In the pivotal shaft 3, a spacer 13 is interposed between an E ring 12 and a step portion if on the other-end side of the stepped shaft hole 1*d*. A sealing 14 is arranged on the outer-end side of the E ring 12 to prevent foreign matter such as mud from entering the housing 1, and the end portion of the stepped shaft hole 1*d* is covered with a cover 15.

The slider receiver 4 has a slider piece 16 which is in slidable contact with the resistor pattern 6*a*, and the slider receiver 4 is biased on the insulating substrate 6 by the elastic force of a wavy washer 17. The lead wire 9 soldered on the terminal 8 is lead from the peripheral wall constituting the cylindrical portion 1*a* on the one-end side of the housing 1 to the outside of the housing 1.

In such an electric part described above, the positioning hole 6*b* is formed at the central portion of the insulating substrate 6 having the resistor pattern 6*a* formed thereon. The resistor pattern 6*a* is printed on the insulating substrate 6 by using a printing mask (not shown) with reference to the positioning hole 6*b*.

The insulating substrate 6 is fixed on the holder 7 such that the recessed portions 6*c* formed on the outside of the insulating substrate 6 having the resistor pattern 6*a* printed thereon are snap-engaged with the plurality of snap projections 7*a* and 7*b* formed on the holder 7.

However, the resistor pattern 6*a* is printed with reference to the positioning hole 6*b*, and the holder 7 is attached to the insulating substrate 6 having the resistor pattern 6*a* printer thereon with reference to the outside of the insulating substrate 6. That is, these references are different from each other. For this reason, when the insulating substrate 6 is attached to the holder 7 with reference to the combination between these references, the central position of the holder 7 is offset from the central position of the insulating substrate 6.

Furthermore, since a clearance which is too small to hinder snap engagement is formed between the parallel snap projections 7*a* and 7*b* of the holder 7 and the recessed portions 6*c* on the outside of the insulating substrate 6, when the insulating substrate 6 is attached to the holder 7, instability in y and z directions (see FIG. 15) disadvantageously occurs. For this reason, when the insulating substrate 6 is attached to the holder 7, their errors are accumulated, and precision of the relative position between the slider piece 16 and the resistor pattern 6*a* cannot be easily held, respective products have large variations in resistance change characteristic.

The terminal 8 is soldered on the resistor pattern 6*a*, and the lead wire 9 is soldered on the terminal 8. For this reason, a number of portions to be soldered increases to degrade assembling properties.

SUMMARY OF THE INVENTION

As the first means for solving the above problem, there is provided an electric part comprising an insulating substrate having a resistor pattern formed thereon and having at least first and second contact portions formed on the outside of the insulating substrate, and a holder having at least first and second contact portions for attaching the insulating substrate, wherein the first and second contact portions of the holders are arranged at a predetermined angle, the first contact portion of the insulating substrate is brought into contact with the first contact portion of the holder, the second contact portion of the insulating substrate is brought into contact with the second contact portion of the holder, the relationship between the first contact portion of the insulating substrate and the first contact portion of the holder is defined such that one of the first contact portions is constituted by a linear surface and the other is constituted by a linear surface or a linear reference surface, one of the second contact portion of the insulating substrate and the second contact portion of the holder is constituted by a linear surface, and the insulating substrate is attached to the holder.

As the second mean for solving the above problem, there is provided an electric part wherein the first and second contact portions of the insulating substrate and the first and second contact portions of the holder are constituted by linear surfaces, respectively.

As the third means for solving the problem, there is provided an electric pattern wherein a terminal connected to the resistor pattern is arranged on the first or second contact potion formed in the holder to connect the terminal and the resistor pattern to each other.

As the fourth means for solving the problem, there is provided an electric pattern wherein a clip-like opening is formed in the terminal connected to the resistor pattern, the insulating substrate is held by the clip-like opening, and the terminal is connected to the resistor pattern.

As the fifth means for solving the problem, there is provided an electric pattern wherein a third contact portion is formed between the first and second contact portions of the holder which are formed at a predetermined angle, a third contact portion is formed on the outside of the insulating substrate, and the third contact portions of the holder and the insulating substrate are brought into contact with each other.

As the sixth means for solving the problem, there is provided an electric pattern wherein an elastic member is arranged between the first and second contact portions of the holder which are formed at the predetermined angle, and the elastic member is elastically pressed on the third contact portion formed on the outside of the insulating substrate to bring the first contact portion of the insulating substrate into press contact with the first contact portion of the holder and to bring the second contact portion of the insulating substrate into press contact with the second contact portion of the holder, thereby holding the insulating substrate in the holder.

As a seventh means for solving the problem, there is provided an electric pattern wherein a conductive terminal is arranged on the holder, a connection member is arranged between the conductive terminal and the resistor pattern of the insulating substrate, and the conductive terminal and the resistor pattern are held by the connection member to electrically connect the conductive terminal and the resistor pattern to each other.

As the eighth means for solving the problem, there is provided an electric part wherein the connection member is constituted by two clips.

As the ninth means for solving the problem, there is provided an electric part comprising a housing, an opening formed in the housing, a holder attached to be press-fitted in the opening, and a thin skirt portion arranged around the outer peripheral edge of the holder, and wherein the skirt portion is press-fitted into the opening to attach the holder to the housing.

DETAILED DESCRIPTION OF THE PREFERRED EMBODIMENTS

An electric part according to an embodiment of the present invention will be described below with reference to FIGS. 1 to 11 by using a vehicle height sensor used in an automobile or the like.

FIGS. 1 to 8 show a vehicle height sensor according to the first embodiment of the electric part of the present invention. The first embodiment will be described below. An opening 21*b* is formed in a cylindrical portion 21*a* arranged on a one-end side of a housing 21 consisting of a synthetic resin or the like. A hollow portion having a step portion 21*c* is formed in the housing 21. A lead wire extraction hole 21*e* is formed in a projection portion 21*d* formed on the outer peripheral portion of the cylindrical portion 21*a*. A recessed portion 21*g* is formed in a cylindrical portion 21*f* arranged on an other-end side of the housing 21. The recessed portion 21*g* is partitioned by a bottom wall 21*h*, and a bearing holder 21*k* is formed in a hollow portion 21*j* in the bottom wall 21*h* such that the bearing holder 21*k* projects in the axial direction.

Figure 1:
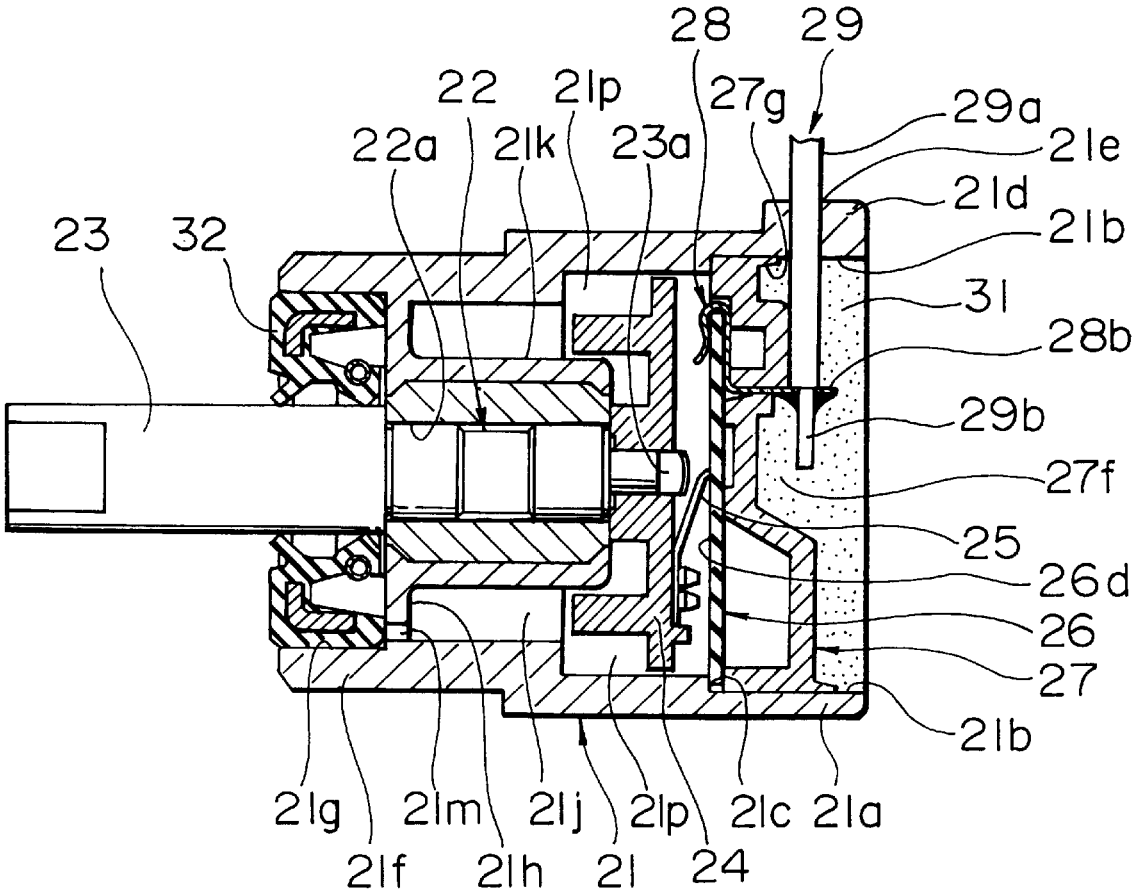
FIG. 1 is a sectional view showing a vehicle height sensor according to the present invention.
Figure 2:
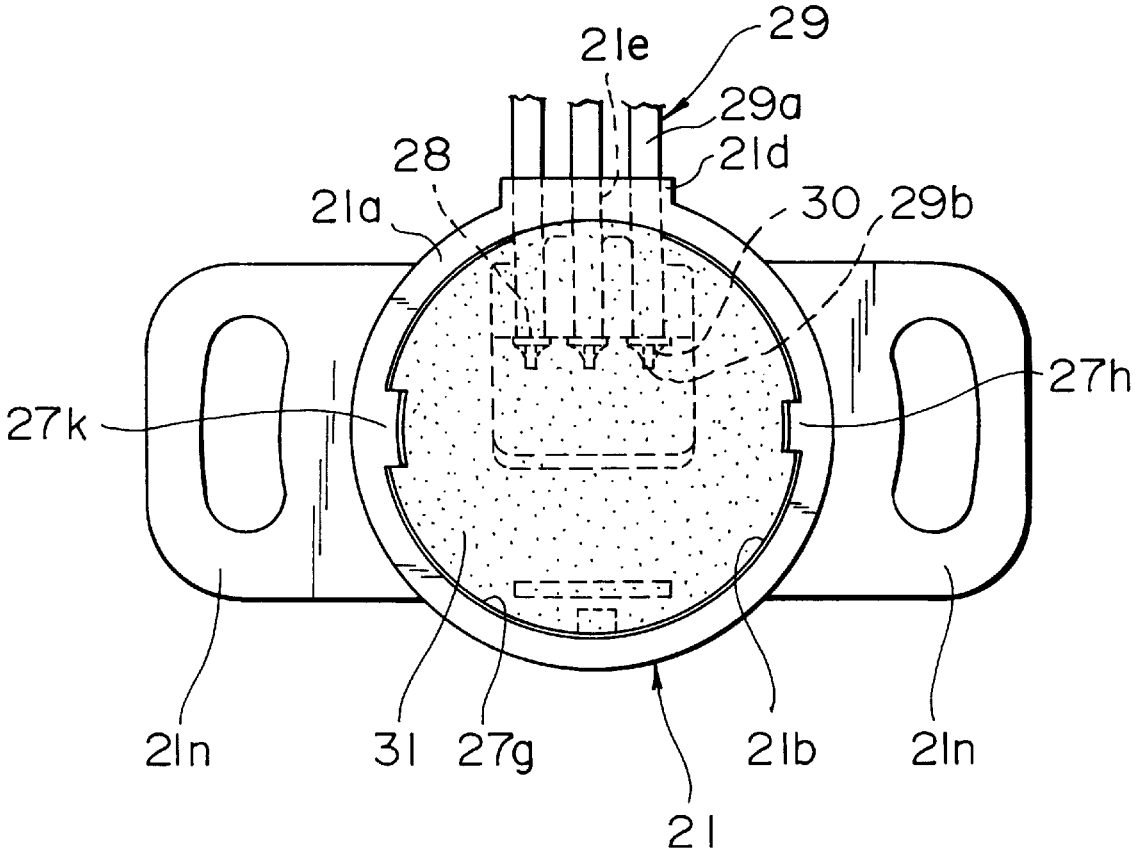
FIG. 2 is a right-side view showing the sensor in FIG. 1.

An air bent hole 21*m* is formed in the bottom wall 21*h* to communicate with the hollow portion 21*j*. Left and right arm portions 21*n* shown in FIG. 2 are formed outside the housing 21. The arm portions 21*n* are fixed to the vehicle body by screws or the like so that the vehicle height sensor can be attached to the body.

A bearing 22 consisting a metal or the like is attached to the bearing holder 21*k* by insert molding the moment the housing 21 is molded. A pivotal shaft 23 consisting of a metal such as aluminum is rotatably inserted into a shaft hole 22*a* of the bearing 22. One end of the pivotal shaft 23 projected from the other-end side, a slider receiver 24 consisting of a synthetic resin or the like is attached to a thin shaft portion 23*a* of the distal end of the pivotal shaft 23 by calking, and is incorporated in a slider receiver storing portion 21*p* in the housing 21. The root portion of the thin shaft portion 23*a* of the pivotal shaft 23 is formed to have an elliptical shape like the central hole of the slider receiver 24 to be engaged with the root portion. The slider receiver 24 is attached to the pivotal shaft 23 such that the slider receiver 24 is interlocked with the pivotal shaft 23.

The slider receiver storing portion 21*p* and the hollow portion 21*j* communicate with each other to communicate with the air bent hole 21*m*.

Figure 3:
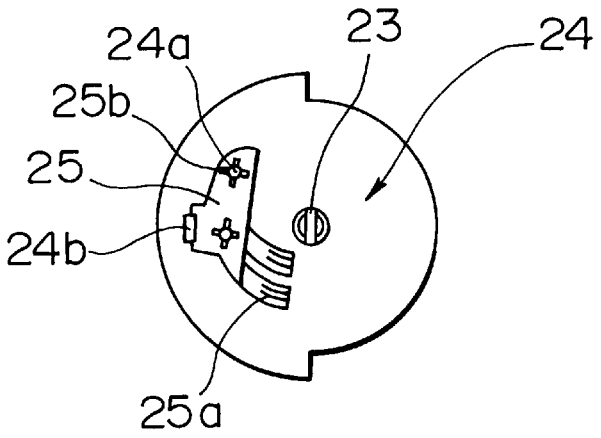
FIG. 3 is a plan view showing a united slider receiver shown in FIG. 1.

As shown in FIG. 3, a slider piece 25 constituted by a metal thin plate consisting of phosphor bronze and having elasticity is attached on one surface of the slider receiver 24 to unite the slider receiver 24. A cross-shaped hole 25*b* is formed in the flat surface, and a brush-like contact point 25*a* is formed at one end of the flat surface. The cross-shaped hole 25*b* is press-fitted on a projection 24*a* of the slider receiver 24. A projection portion 24*b* is formed on the slider receiver 24 at a position where the other end of the flat surface of the slider piece 25 is located, and the slider piece 25 is held between the projection portion 24*b* and the slider receiver 24.

Figure 4:
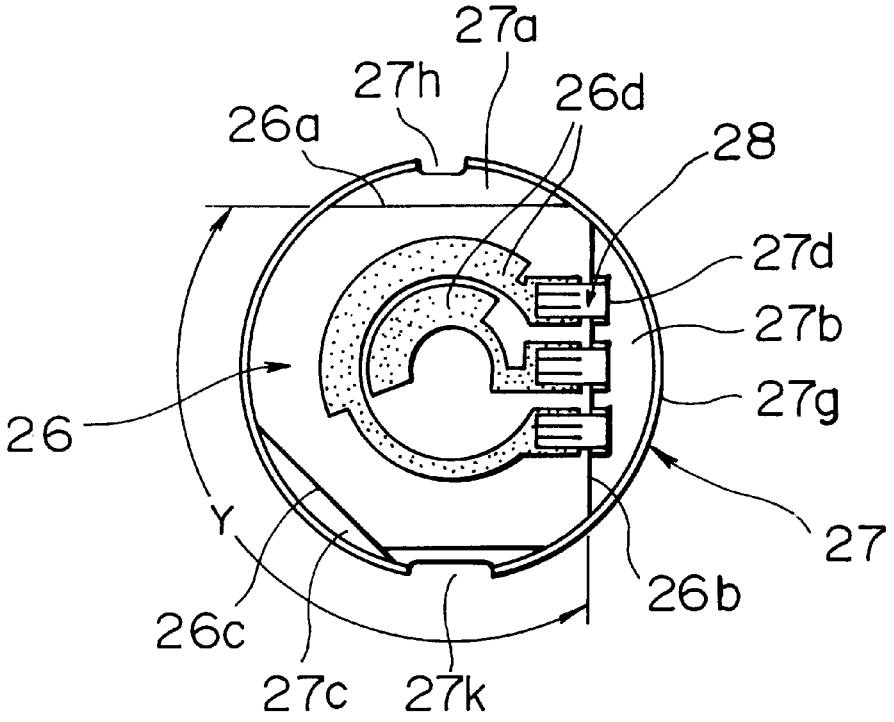
FIG. 4 is a plan view showing a united holder shown in FIG. 1.

On the side opposing the surface of the slider receiver 24 on which the slider piece 25 is attached, a holder 27 having an insulating substrate 26 consisting of ceramic or the like is attached at a predetermined position such that the holder 27 is press-fitted in the opening 21*b* of the housing 21. As shown in FIG. 4, the outside of the insulating substrate 26 is constituted as follows. That is, at least first and second contact portions 26*a* and 26*b* are formed at a predetermined angle Y, e.g., right angle, on a linear surface, a third contact portion 26*c* is formed between the first and second contact portions 26*a* and 26*b* formed at the predetermined angle, a resistor pattern 26*d* is printed on the surface of the insulating substrate 26 in the form of an arc. Since the resistor pattern 26*d* is printed with reference to two outside surfaces of the first and second contact portions 26*a* and 26*b*, the first and second contact portions 26*a* and 26*b* of the insulating substrate 26 are not easily offset from the resistor pattern 26*d*.

Figure 5:
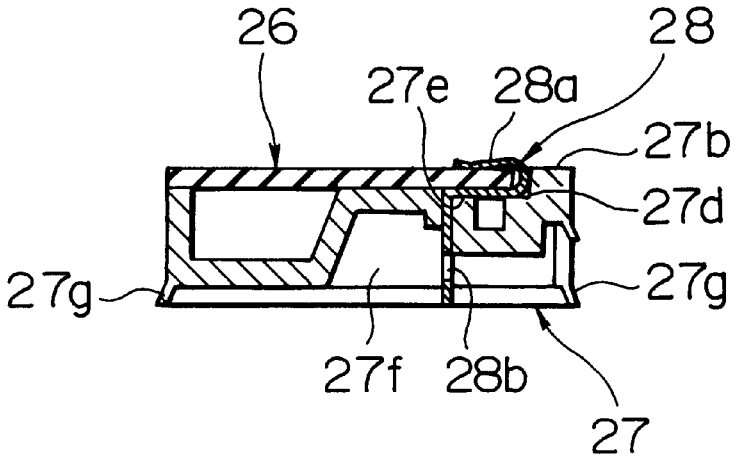
FIG. 5 is a sectional view showing a main part in FIG. 4.

The holder 27 consisting of a soft synthetic resin such as nylon is formed by the following manner. That is, as shown in FIGS. 4 and 5, on one surface to which the insulating substrate 26 is attached, a first contact portion 27*a* constituted by a projection and a second contact portion 27*b* constituted by a projection are formed at a predetermined angle Y, e.g., right angle, and the first and second contact portions 27*a* and 27*b* have heights which are equal to or larger than the thickness of the insulating substrate 26. The first and second first contact portions 26*a* and 26*b* of the insulating substrate 26 are held between the first and second contact portions 27*a* and 27*b* of the holder 27 to be brought into contact with the first and second contact portions 27*a* and 27*b*, thereby positioning the insulating substrate 26.

A third contact portion 27*c* constituted by a projection is formed between the first contact portion 27*a* and the second contact portion 27*b* which are arranged at the predetermined angle Y to have a height equal to that of the first and second contact portions 27*a* and 27*b*.

A terminal guide groove 27*d* is formed in the second contact portion 27*b*, and a terminal attaching hole 27*e* is formed near the terminal guide groove 27*d*. A recessed portion 27*f* is formed in the central portion on the lower surface of the holder 27, and a skirt portion 27*g* is formed around the outer peripheral edge of the holder 27 to have a small thickness. A large and small positioning grooves 27*h* and 27*k* are formed in the direction of the outer peripheral axis of the holder 27. When the holder 27 is inserted into the opening 21*b* of the housing 21 by the positioning grooves 27*h* and 27*k*, the position of the holder 27 in a rotational direction is determined.

A terminal 28 consisting of a metal material such as phosphor bronze having elasticity is attached to the terminal attaching hole 27*e*. A clip portion 28*a* having one end formed in the form of a clip is formed at the end of the terminal 28. The insulating substrate 26 is held by the opening of the clip portion 28*a*, so that the resistor pattern 26*d* and the terminal 28 are electrically connected to each other. The other end of the terminal 28 is planar and bent downward, and a lead wire attaching portion 28*b* serving as the other end of the terminal 28 is press-fitted in the terminal attaching hole 27*e* of the holder 27.

A lead wire 29 is arranged by the following manner. That is, as shown in FIG. 2, a coverage portion 29*a* is drawn from the lead wire extraction hole 21*e* of the housing 21 into the housing 21, and a conductive portion 29*b* is inserted into the lead wire attaching portion 28*b* of the terminal 28 and then attached by solder 30, thereby electrically connecting the terminal 28 and the lead wire 29 to each other.

The holder 27 is press-fitted in the opening 21*b*, and the opening 21*b* and the slider receiver storing portion 21*p* are shielded from each other by the skirt portion 27*g*. The slider receiver storing portion 21*p* in the housing 21 is airtightly sealed in the opening 21*b* on the lower surface of the holder 27 by a filler 31 consisting of a thermosetting resin or the like. A sealing 32 is press-fitted in the recessed portion 21*g* of the cylindrical portion 21*f* on the other-end side of the housing 21 to seal the interior of the housing 21, thereby preventing foreign matter such as dust from entering the interior of the housing 21. The vehicle height sensor with the above arrangement is attached to a vehicle body, and the pivotal shaft 23 is rotated by operating the accelerator of the vehicle. The contact point 25*a* of the slider piece 25 is slid on the surface of the resistor pattern 26*d* of the insulating substrate 26 to change the resistance. A throttle position can be detected by checking the change in resistance.

A vehicle height sensor having the above arrangement and serving as an electric part according to the present invention is assembled by the following manner. The pivotal shaft 23 is inserted into the shaft hole 22*a* of the bearing 22 formed in the housing 21 by insert molding, the thin shaft portion 23*a* at the other end of the pivotal shaft 23 is inserted into the slider receiver 24 united with the slider piece 25, and the thin shaft portion 23*a* at the other end of the pivotal shaft 23 is calked by a split calk. In this case, the slider receiver 24 is interlocked with the pivotal shaft 23 to be rotated with rotation of the pivotal shaft 23, and is arranged in the slider receiver storing portion 21*p* in the housing 21.

The united slider receiver 24 is assembled by the following manner. That is, as shown in FIG. 3, when the cross-shaped hole 25*b* in the flat surface of the slider piece 25 is press-fitted on the projection 24*a* by a jig (not shown), even if the slider piece 25 receives external pressure which deflects the contact point 25*a* by the effect of the cross-shaped hole 25*b*, the cross-shaped hole 25*b* is prevented from being removed from the projection 24*a*. For this reason, the slider piece 25 is not disconnected from the slider receiver 24.

The holder 27 united with the terminal 28 and the insulating substrate 26 is assembled by the following manner. That is, as shown in FIGS. 4 and 5, when the lead wire attaching portion 28*b* is inserted into the terminal attaching hole 27*e*, the tip of the lead wire attaching portion 28*b* breaks a soft flash formed during molding in the opening of the terminal attaching hole 27*e* on the recessed portion 27*f* side, and the terminal 28 is attached such that the clip portion 28*a* is guided by the projection 27*b* formed on the second contact portion 27*b*.

When the insulating substrate 26 having the resistor pattern 26*d* facing upward is placed on the third contact portion 27*c* of the holder 27 and then slid on the first contact portion 27*a* side, the first contact portion 26*a* of the insulating substrate 26 is brought into contact with the first contact portion 27*a* of the holder 27. When the insulating substrate 26 is pressed such that the first contact portion 26*a* guides the first contact portion 27*a* of the holder 27, the second contact portion 26*b* of the insulating substrate 26 moves on the second contact portion 27*b* of the holder. At the same time, the second contact portion 26*b* is inserted into the opening of the clip portion 28*a*, and the terminal 28 is connected to the second contact portion 26*b*. In addition, when the second contact portion 26*b* of the insulating substrate 26 is pressed on the second contact portion 27*b* side of the holder, the second contact portion 26*b* is brought into contact with the second contact portion 27*b* of the holder. At the same time, the insulating substrate 26 is positioned such that the first and second contact portions 26*a* and 26*b* are held between the first and second contact portions 27*a* and 27*b* to be brought into contact with the first and second contact portions 27*a* and 27*b*, and the insulating substrate 26 is held by elastic force of the clip portion 28*a*. The insulating substrate 26 is temporarily fixed on the holder 27.

Thereafter, the third contact portion 26*c* of the insulating substrate 26 slidably falls down on the linear surface on which the third contact portion 27*c* of the holder 27 is formed, and is brought into contact with the third contact portion 27*c*. For this reason, the insulating substrate 26 is supported by the three points, i.e., the first, second, and third contact portions 27*a*, 27*b*, and 27*c* of the holder 27, and held by the clip portion 28*a*, and the insulating substrate 26 is reliably held by the holder 27 to be united. Therefore, the holder 27 can be easily handled until the holder 27 is incorporated in the opening 21*b* of the housing 21, thereby improving assembling properties.

When the united holder 27 is pressed into the opening 21*b* such that the large and small positioning grooves 27*h* and 27*k* are aligned to a projection portion (not shown) formed inside the opening 21*b* of the housing 21, the thin skirt portion 27*g* of the holder 27 is brought into contact with the opening 21*b*. When the holder 27 is pressed by stronger force, the skirt portion 27*g* of the holder 27 is deformed to have the same size as the inner diameter of the opening 21*b* and pressed to reach the step portion 21*c*. The insulating substrate 26 is sandwiched by the step portion 21*c* and the holder 27 to fix the insulating substrate 26 in the housing 21. At this time, the holder 27 is brought into tight contact with the opening 21*b* by the skirt portion 27*g* to be strongly fixed to the opening 21*b*, and the opening 21*b* and the slider receiver storing portion 21*p* are shielded from each other by the skirt portion 27*g*. At this time, the contact point 25*a* of the slider piece 25 is brought into slidable contact with the resistor pattern 26*d* of the insulating substrate 26.

The coverage portion 29*a* of the lead wire 29 is inserted into the lead wire extraction hole 21*e* of the housing 21, and the conductive portion 29*b* of the lead wire 29 is attached to the holder 27 and inserted into the lead wire attaching portion 28*b* of the terminal 28, and the lead wire 29 is connected and fixed by the solder 30.

In order to reliably airtightly seal the housing 21 whose interior is shielded by the holder 27, the filler 31 consisting of an epoxy-based material is filled in the opening 21*b* on the lower surface side of the holder 27. When the filler 31 is put in a furnace or tank at a temperature of about 100° C. to harden the filler 31 or enhance hardening, the temperature of the housing 21 increases, air in the slider receiver storing portion 21*p* and the hollow portion 21*j* is expanded. Since the expanded air is discharged out of the housing from the air bent hole 21*m* of the bottom wall 21*h*, the air does not adversely affect the insulating substrate 26 and the holder 27.

After the filler 31 is hardened, when the sealing 32 is press-fitted in the recessed portion 21*g* of the housing 21, the air bent hole 21*m* is sealed, and the hollow portion of the housing 21 is shielded from the outside to be airtightly sealed. Since the sealing 32 is rotatably arranged without gap between the sealing 32 and the periphery of the pivotal shaft 23, the airtight sealing state in the hollow portion is not prevented by the portion of the pivotal shaft 23. Even if the pivotal shaft 23 is arranged without gap between the pivotal shaft 23 and the sealing 32, the pivotal shaft 23 can be rotated without any hinderance.

In the embodiment of the present invention, the shapes of the first and second contact portions 26*a* and 26*b* of the insulating substrate 26 and the shapes of the first and second contact portions 27*a* and 27*b* of the holder 27 are not limited to the linear surfaces described above. The shapes as shown in FIGS. 6 to 8 may be used.

Figure 6:
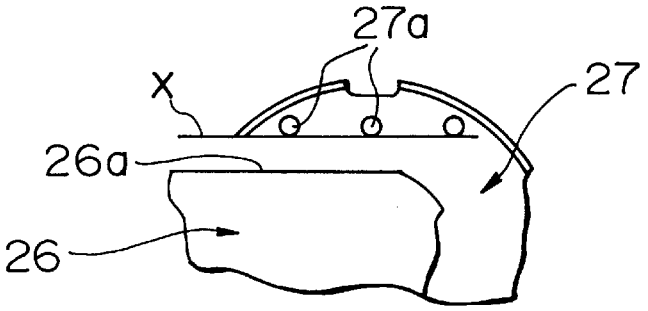
FIG. 6 is a schematic view for explaining a modification of the contact portion according to the present invention.

As shown in FIG. 6, the first contact portion 26*a* of the insulating substrate 26 or the second contact portion 26*b* of the insulating substrate 26 is formed on a linear surface, the first contact portion 27*a* of the holder 27 or the second contact portion 27*b* of the holder 27 with which the first contact portion 26*a* is brought into contact may be constituted by a linear reference surface X for connecting the outer peripheral surfaces of a plurality of rod-like projections to each other. In addition, although not shown here, the first contact portion 26*a* and the first contact portion 27*a* may have relationship opposing the above relationship. That is, the first contact portion 26*a* or the second contact portion 26*b* of the insulating substrate 26 may be constituted by the linear reference surface X, and the first contact portion 27*a* or the second contact portion 27*b* of the holder 27 may be constituted by a linear surface.

Figure 7:
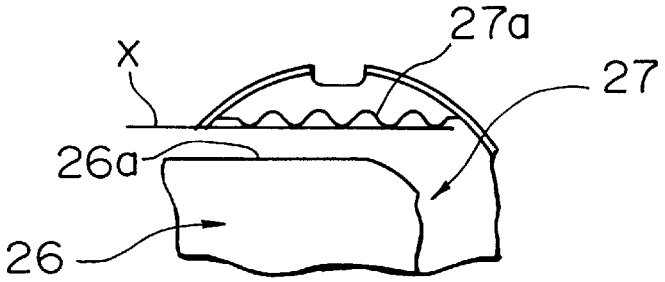
FIG. 7 is a schematic view for explaining another modification of the contact portion according to the present invention.

As shown in FIG. 7, the first contact portion 26*a* or the second contact portion 26*b* of the insulating substrate 26 may be constituted by a linear surface, and the first contact portion 27*a* of the holder 27 with which the first contact portion 26*a* is brought into contact may be constituted by a linear reference surface X for connecting the tops of a plurality of wavy projection portions. Furthermore, although not shown here, the first contact portion 26*a* and the first contact portion 27*a* may have relationship opposing the above relationship. That is, the first contact portion 26*a* or the second contact portion 26*b* of the insulating substrate 26 may be constituted by the linear reference surface X, and the first contact portion 27*a* or the second contact portion 27*b* of the holder 27 may be constituted by a linear surface.

Figure 8:
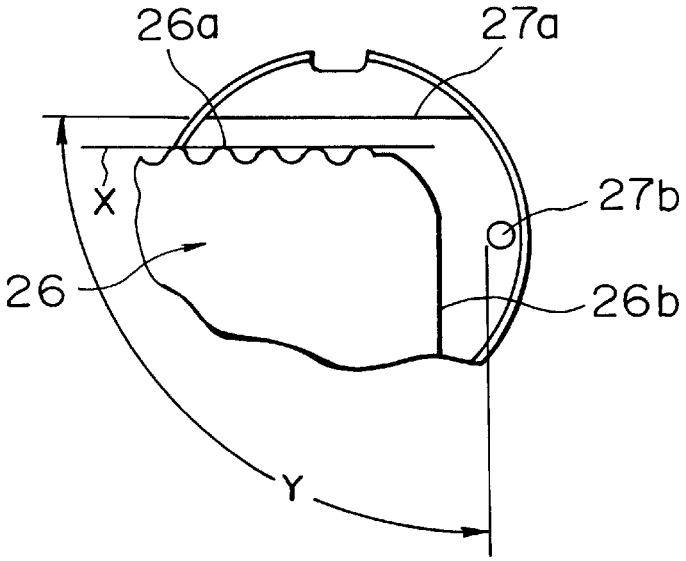
FIG. 8 is a schematic view for explaining still another modification of the contact portion according to the present invention.

As shown in FIG. 8, the first contact portion 26*a* of the insulating substrate 26 or the first contact portion 27*a* of the holder may be constituted by the shapes described in FIGS. 6 and 7, the second contact portion 26*b* of the insulating substrate 26 is constituted by a linear surface, and the second contact portion 27*b* of the holder 27 may be constituted by one rod-like projection or the like. In addition, although not shown here, the second contact portion 26*b* and the second contact portion 27*b* may have relationship opposing the above relationship. That is, the second contact portion 26*b* of the insulating substrate 26 may be constituted by one rod-like projection or the like, and the second contact portion 27*b* of the holder 27 may be constituted by a linear surface.

More specifically, in the arrangement shown in FIGS. 6 to 8, one of the first contact portion 26*a* of the insulating substrate 26 and the first contact portion 27*a* of the holder 27 is constituted by a linear surface, and the other is constituted by a linear surface or a linear reference surface. One of the second contact portion 26*b* of the insulating substrate 26 and the second contact portion 27*b* of the holder 27 is constituted by a linear surface, and the insulating substrate 26 is attached to the holder 27.

Figure 9:
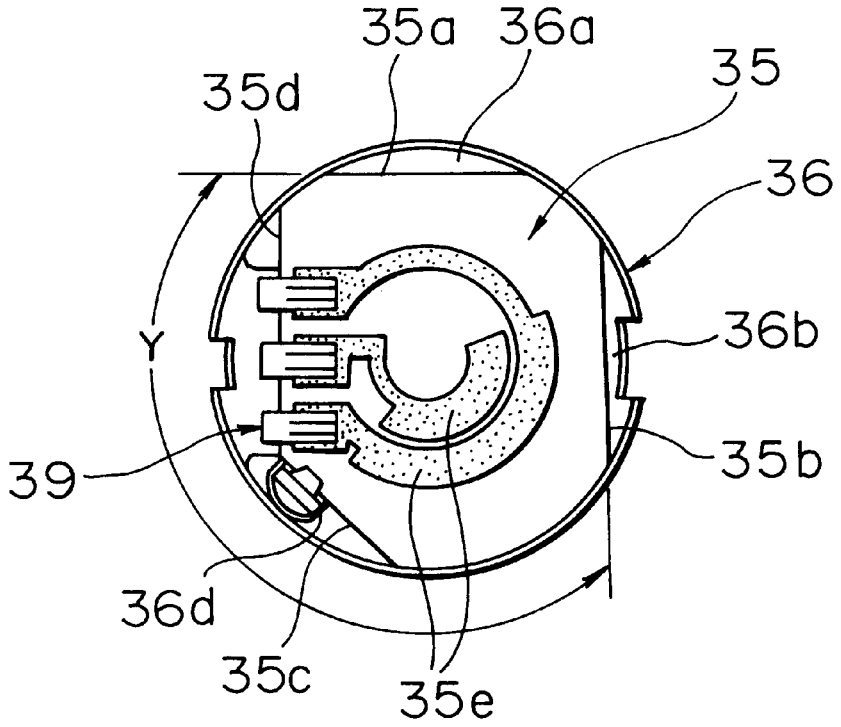
FIG. 9 is a plan view showing a united holder for explaining the second embodiment of the present invention.
Figure 10:
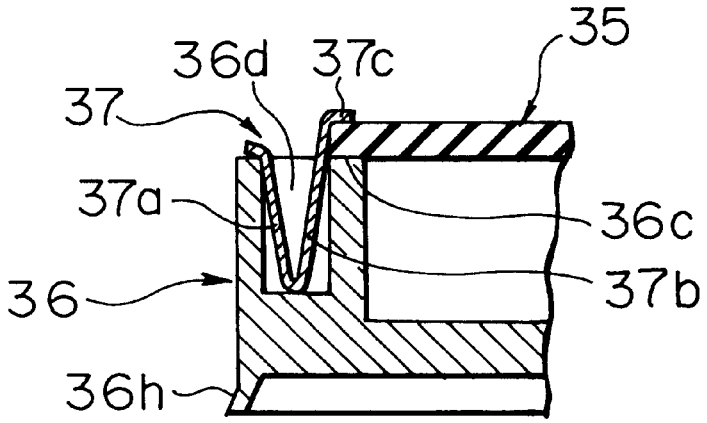
FIG. 10 is a schematic view for explaining the second embodiment of the present invention.
Figure 11:
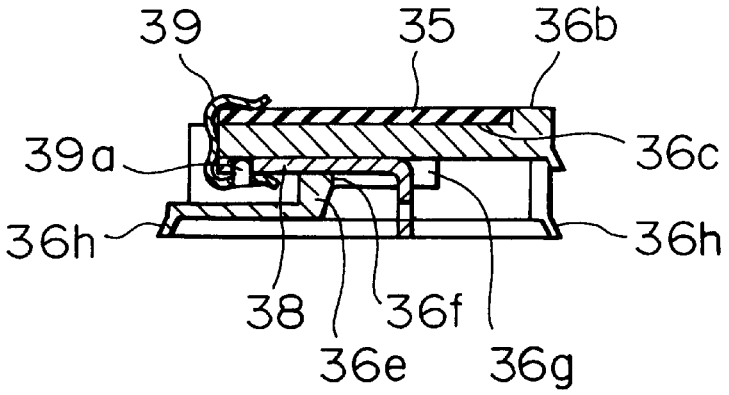
FIG. 11 is a sectional view showing a main part of a united holder for explaining the second embodiment of the present invention.

The second embodiment of the present invention will be described below with reference to FIGS. 9 to 11. According to the second embodiment, the portion of a united holder 36 is different from that in the first embodiment. For this reason, only the portion of the united holder 36 will be described. Since the remaining portions are the same as those in the arrangement of the first embodiment, a description thereof will be omitted.

An insulating substrate 35 has the following outside. At least first and second contact portions 35*a* and 35*b* are linearly formed at a predetermined angle Y, e.g., right angle, and third and fourth contact portions 35*c* and 35*d* are formed between the first and second contact portions 35*a* and 35*b* formed at the predetermined angle Y, and a resistor pattern 35*e* is printed on the surface of the insulating substrate 35 in the form of an arc. Since the resistor pattern 35*e* is printed with reference to the two first and second contact portions 35*a* and 35*b*, a printing error between the outside of the insulating substrate 35 and the resistor pattern 35*e* does not easily occur.

The holder 36 consisting of a soft synthetic resin such as nylon is constituted by the following manner. That is, a first contact portion 36*a* and a second contact portion 36*b* are formed on a linear surface at a predetermined angle Y, e.g., right angle, and the first and second contact portions 35*a* and 35*b* of the insulating substrate 35 are held between the first and second contact portions 36*a* and 36*b* formed at the predetermined angle Y so that the first and second contact portions 36*a* and 36*b* are brought into contact with the first and second contact portions 35*a* and 35*b*. The holder 36 is formed to have a height equal to or larger than the thickness of the insulating substrate 35.

An elastic member holding hole 36*d* having a square shape and a predetermined depth is formed between the first and second contact portions 36*a* and 36*b* formed at the predetermined angle Y. A terminal attaching hole 36*f* is formed in a partition wall 36*e* on the lower surface side of the holder 36 to horizontally communicate with a terminal guide 36*g*.

An elastic member 37 consisting of a metal material such as phosphor bronze having elasticity is formed in the form of a V shape and inserted into the elastic member holding hole 36*d*, a third contact portion 35*c* of the insulating substrate 35 is elastically pressed by the elastic force of elastic members 37*a* and 37*b* to bring the first and second contact portions 35*a* and 35*b* of the insulating substrate 35 into elastic contact with the first and second contact portions 36*a* and 36*b*.

An end portion 37*c* of one elastic member 37*b* is bent at right angle to prevent the insulating substrate 35 from floating from a substrate attaching surface 36*c*.

An L-shaped conductive terminal 38 constituted by a material such as a steel plate is inserted into the terminal attaching hole 36*f* formed in the lower surface of the holder 36.

When the connection member 39 which consists of a metal material such as phosphor bronze having elasticity and has a U shape opened in one side is inserted between one end of the conductive terminal 38 and the fourth contact portion 35*d* to be held therebetween, the resistor pattern 35*e* and the conductive terminal 38 are electrically connected to each other. A projection 39*a* is formed to prevent the connection member 39 from being laterally offset when the conductive terminal 38 is held in the width direction by the connection member 39 on the side in which one end of the conductive terminal 38 is inserted.

In assembling the united holder 36 according to the second embodiment of a vehicle height sensor serving as an electric part having the above arrangement according to the present invention, the conductive terminal 38 is guided by the terminal guide 36*g* on the lower surface of the holder 36 to be press-fitted in the terminal attaching hole 36*f*. This press fitting can be achieved by press-fitting strength at which the conductive terminal 38 can be manually pressed into the terminal attaching hole 36*f*.

The first contact portion 35*a* of the insulating substrate 35 is brought into contact with the projection 36*a* of the holder 36 to which the conductive terminal 38 is attached, and the insulating substrate 35 is pressed such that the first contact portion 35*a* guides the first contact portion 36*a* of the holder 36. In this case, the second contact portion 35*b* moves on the second contact portion 36*b* side of the holder 36, and the insulating substrate 35 is brought into contact with the holder 36 such that the first and second contact portions 35*a* and 35*b* are held between the first and second contact portions 36*a* and 36*b* of the holder 36.

When the elastic members 37*a* and 37*b* of the elastic member 37 are pressed into the elastic member holding hole 36*d*, the elastic member 37*b* elastically presses the third contact portion 35*c* of the insulating substrate 35, the insulating substrate 35 is brought into elastic contact with the first contact portion 36*a* of the holder 36, and the second contact portion 35*b* is brought into elastic contact with the second contact portion 36*b*. In this manner, the insulating substrate 35 is positioned by the holder 36 to be attached to the substrate attaching surface 36*c*.

When the elastic member 37 is further pressed to the bottom surface of the elastic member holding hole 36*d*, the end portion 37*c* of the elastic member 37*b* bent at right angle presses the surface of the third contact portion 35*c* of the insulating substrate 35 against the substrate attaching surface 36*c* to prevent the insulating substrate 35 from floating from the holder 36.

When one end of the conductive terminal 38 and the fourth contact portion 35*d* of the insulating substrate 35 are inserted into the opening of the U-shaped portion of the connection member 39, the resistor pattern 35*e* and the conductive terminal 38 is electrically connected to each other. At this time, since the conductive terminal 38 is guided by the projection 39*a* in the width direction, the connection member 39 is positioned. Therefore, the connection member 39 is not in contact with an adjacent connection member 39, so that short-circuiting can be prevented.

The united holder 36 assembled as described above is inserted into the opening 21*b* of the housing 21 to press-fit a skirt portion 36*h* in the opening 21*b*. Thereafter, assembly is performed by the method described in the first embodiment, assembly of a throttle position center according to the second embodiment of the present invention is completed.

Figure 12:
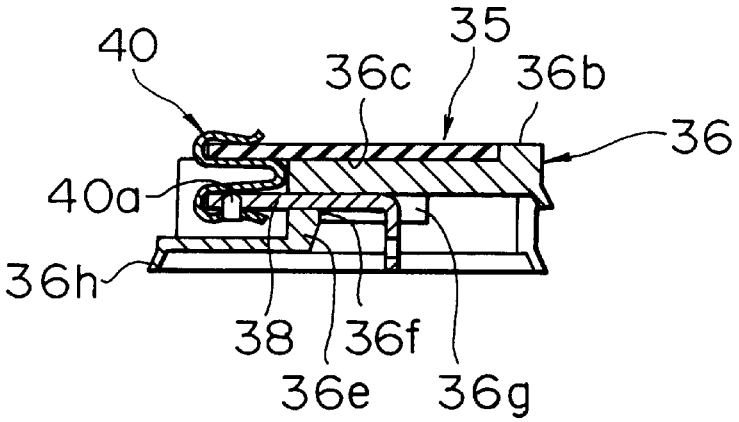
FIG. 12 is a sectional view showing a main part for explaining another embodiment of the present invention.

As another embodiment, as shown in FIG. 12, the connection member 39 may be constituted by a double clip 40 having two clip portions. In this case, since one end of the conductive terminal 38 and the fourth contact portion 35*d* of the insulating substrate 35 on which the resistor pattern 35*e* is formed can be reliably held between the two clip portions, an electric part having high reliability can be provided.

Figure 13:
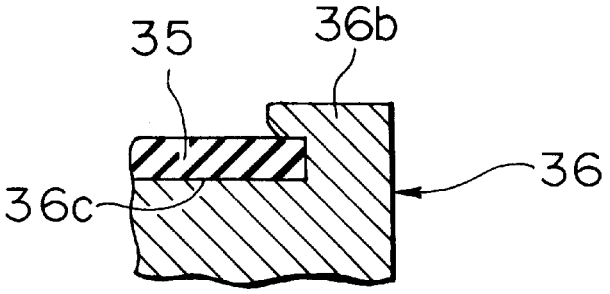
FIG. 13 is a schematic sectional view for explaining still another embodiment of the present invention.
Figure 14:
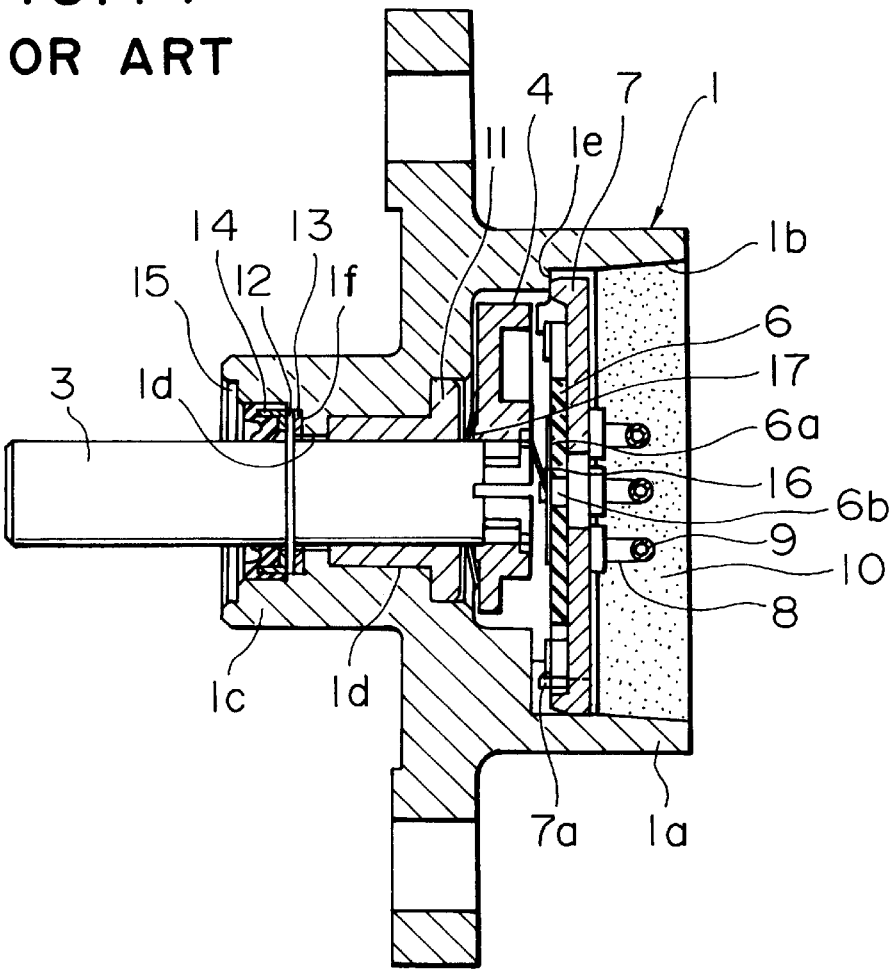
FIG. 14 PRIOR ART
FIG. 14 is a sectional view showing a conventional vehicle height sensor.
Figure 15:
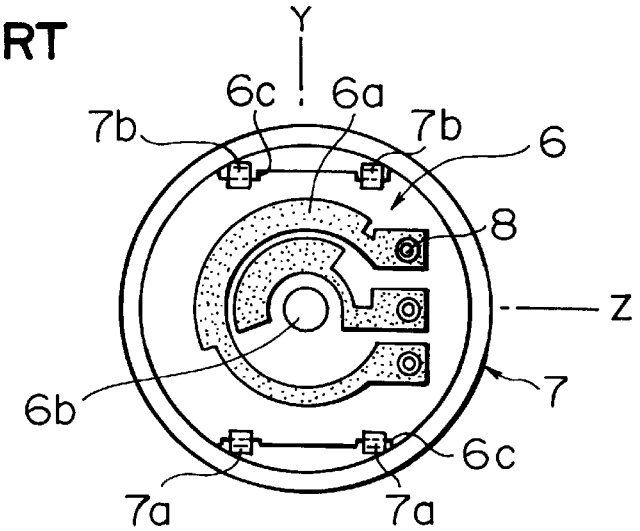
FIG. 15 PRIOR ART
FIG. 15 is a plan view showing a conventional united holder.

As still another embodiment, as shown in FIG. 13, the first and second contact portions 36*b* and 36*b* of the holder 36 are formed in the form of an L shape, and the first and second contact portions 35*a* and 35*b* of the insulating substrate 35 are inserted into the L-shaped portion. In this case, the insulating substrate 35 can be attached to the substrate attaching surface 36*c* of the holder 36 without gap, and the insulating substrate 35 can be prevented from floating from the substrate attaching surface while the united holder 36 incorporated in the housing 21.

As has been described above, an electric part according to the present invention has at least first and second contact portions formed on the outside of an insulating substrate on which a resistor pattern is formed and at least first and second contact portions for attaching the insulating substrate to a holder. For this reason, a resistor pattern can be printed with reference to the first and second contact portions of the insulating substrate, and the insulating substrate can be attached to the holder with reference to the first and second contact portions of the insulating substrate. For this reason, since a printing operation of the resistor pattern and an attaching operation of the insulating substrate to the holder are performed by using the same reference surface, an error in the assembling operation can be reduced. Therefore, the precision of the relative positions of a slider piece and the resistor pattern is improved, and electric parts having small variation in resistance and high precision can be provided.

Since the first and second contact portions of the insulating substrate and the first and second contact portions of the holder are constituted by linear surfaces, respectively, the insulating substrate can be easily processed. Therefore, an insulating substrate can be provided at low cost.

A terminal connected to the resistor pattern are arranged to the first or second contact portion formed on the holder to connect the terminal to the resistor pattern. For this reason, the moment the insulating substrate is brought into contact with the first and second contact portions of the holder to position the insulating substrate, the resistor pattern can be electrically connected to the terminal. Therefore, assembling properties can be improved.

A clip-like opening is formed in the terminal, and the insulating substrate is held by the clip-like opening to connect the terminal to the resistor pattern. For this reason, the resistor pattern need not be soldered on the terminal, and assembling properties are improved.

In the holder, a third contact portion is formed between the first and second contact portions arranged at a predetermined angle, a third contact portion is formed on the outside of the insulating substrate, and the third contact portion of the holder is brought into contact with the third contact portion of the insulating substrate. For this reason, since the insulating substrate is attached to be supported at three points by the holder, a positional error of the insulating substrate attached to the holder is not generated. Therefore, the united holder can be easily handled.

An elastic member is arranged between the first and second contact portions of the holder to elastically press the elastic member against the third contact portion formed on the outside of the insulating substrate, and the first contact portion of the insulating substrate and the second contact portion of the insulating substrate are brought into elastic contact with the first contact portion of the holder and the second contact portion of the holder, respectively. For this reason, since the insulating substrate is attached to the holder such that the insulating substrate is supported at three points and brought into elastic contact with the projection, the insulating substrate can be more reliably attached to the holder. In addition, since the insulating substrate can be prevented from floating from the holder, the united holder can be easily handled, and good assembling properties can be obtained.

A conductive terminal is arranged to the holder, and a connection member is arranged between the conductive terminal and the resistor pattern of the insulating substrate, the conductive terminal and the insulating substrate are held by the connection member to connect the conductive terminal to the resistor pattern. For this reason, the resistor pattern need not be soldered on the conductive terminal, and assembling properties are improved.

Since the connection member is constituted by two clips, the insulating substrate and the conductive terminal are reliably held between the two clips. Therefore, the resistor pattern of the insulating substrate can be electrically connected to the conductive terminal without adversely affected by vibration.

Since a thin skirt portion is arranged around the outer peripheral edge of the holder, the housing can be press-fitted in the opening with weak force, and the interior and exterior of the housing can be shielded from each other by the effect of the skirt portion. Therefore, even if a melted filler is filled on the lower surface of the holder, the filler does not flow into the housing.

What is claimed is:

1. A mounting structure for mounting an insulating substrate having a resistor pattern onto a holder, comprising:

a housing;

an insulating substrate disposed in said housing having a surface including a first contact portion and a second contact portion arranged at a predetermined angle relative to said first contact portion;

a holder having a first projection and a second projection, said first projection aligned in contact with said first contact portion and said second projection aligned in contact with said second contact portion to position said substrate within said housing; and a resistor pattern printed on said surface having a position that is directly dependent upon the location of said first contact portion and said second contact portion such that there will be minimal offset between said insulating substrate and said holder when said insulating substrate is attached with said holder.

2. The mounting structure of claim 1, wherein said first contact portion contacts said first projection along a first linear surface and said second contact portion contacts said second projection along a second linear surface.

3. The mounting structure of claim 1, wherein said first contact portion, said second contact portion, said first projection and said second projection are flat surfaces.

4. The mounting structure of claim 1, wherein said first contact portion comprises a plurality of rods, and said second contact portion, said first projection and said second projection are flat surfaces.

5. The mounting structure of claim 1, wherein said second contact portion comprises a plurality of rods, and said first contact portion, said first projection and said second projection are flat surfaces.

6. The mounting structure of claim 1, wherein said first projection comprises a plurality of rods and said first contact portion, said second contact portion, and said second projection are flat surfaces.

7. The mounting structure of claim 1, wherein said second projection comprises a plurality of rods, and said first contact portion, said second contact portion, and said first projection are flat surfaces.

8. The mounting structure of claim 1, wherein said first contact portion comprises a wavy surface, and said second contact portion, said first projection and said second projection are flat surfaces.

9. The mounting structure of claim 1, wherein said second contact portion comprises a wavy surface, and said first contact portion, said first projection and said second projection are flat surfaces.

10. The mounting structure of claim 1, wherein said first projection comprises a wavy surface and said first contact portion, said second contact portion, and said second projection are flat surfaces.

11. The mounting structure of claim 1, wherein said second projection comprises a wavy surface, and said first contact portion, said second contact portion, and said first projection are flat surfaces.

12. The mounting structure of claim 1, further comprising a terminal having a clip portion, said terminal being electrically connected to said substrate by passing said clip portion through a terminal guide groove defined in said second contact portion and contacting said clip portion with said electric pattern formed on said substrate.

13. The mounting structure of claim 1, further comprising an elastic member for urging said insulating substrate against said holder so that said first contact portion of said insulating substrate contacts said first projection of said holder and said second contact portion of said insulating substrate contacts said second projection of said holder.

14. The mounting structure of claim 1, wherein said insulating substrate includes a third contact portion arranged between said first contact portion and said second contact portion and said holder has a third projection arranged between said first projection and said second projection, such that said third projection contacts said third contact portion.

* * * * *

UNITED STATES PATENT AND TRADEMARK OFFICE

CERTIFICATE OF CORRECTION

PATENT NO. : 5,917,402
DATED : June 29, 1999
INVENTOR(S) : Junichi Ebata

It is certified that error appears in the above-identified patent and that said Letters Patent is hereby corrected as shown below:

On the Title Page

In column 1, Item [22] change "Filed: Jun. 30, 1997" to --Filed: June 26, 1997--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*